United States Patent [19]

Fujimoto et al.

[11] Patent Number: 5,048,494

[45] Date of Patent: Sep. 17, 1991

[54] AIR-FUEL RATIO CONTROLLER

[75] Inventors: Takanori Fujimoto; Yoshiaki Kanno, both of Himeji, Japan

[73] Assignee: Mitsubishi Denki Kabushiki Kaisha, Tokyo, Japan

[21] Appl. No.: 531,429

[22] Filed: May 31, 1990

[30] Foreign Application Priority Data

May 31, 1989 [JP] Japan ..... 1-137954

[51] Int. Cl.[5] ..... F02D 41/14

[52] U.S. Cl. ..... 123/489

[58] Field of Search ..... 123/440, 489

[56] References Cited

U.S. PATENT DOCUMENTS 4,767,520 8/1988 Asakura et al. ..... 123/489 X 4,796,589 1/1989 Fujimoto et al. ..... 123/440 X

FOREIGN PATENT DOCUMENTS 55-4943 2/1980 Japan .

*Primary Examiner*—Tony M. Argenbright

*Attorney, Agent, or Firm*—Sughrue, Mion, Zinn, Macpeak & Seas

[57] ABSTRACT

An air-fuel ratio controller which detects oxygen content of the engine exhaust gases, compares the detected value with an objective oxygen content corresponding to an objective air-fuel ratio and integrates the deviation therebetween, smoothes the integrated values to absorb errors in control caused by variations in an injector or the like, and controls the air-fuel ratio in accordance with such integrated and smoothed values. The air-fuel ratio controller always controls the air-fuel ratio properly by stopping the smoothing of the integrated values when, for example, the detected oxygen content is disordered, and the detected values do not vary remarkably for more than a predetermined period.

3 Claims, 11 Drawing Sheets

AIR-FUEL RATIO CONTROLLER

BACKGROUND OF THE INVENTION

1. Field of the Invention

The present invention relates to an air-fuel ratio controller for an internal combustion engine.

2. Description of Related Art

For example, in the Japanese Patent Publication No. 55-4943 (1980), the outputs of an oxygen content detecting means for detecting the oxygen content of the exhaust gases of an internal combustion engine are compared with a predetermined level, and the deviations are integrated and smoothed, and the air-fuel ratio is controlled by feedback depending on the sum of the integrated value and the smoothed value. This smoothing is intended to absorb the individual variations of injectors or the like and the individual differences of parts caused by deterioration of age, and practically it is intended by determining the mean of the integrated values.

Since the integrated value depends on the outputs of the oxygen content detecting means, when these outputs are not normal, for example, when these outputs do not change largely enough over a specific time, the coefficients of feedback control are not corrected properly, so that the air-fuel ratio for a normal operation of the internal combustion engine cannot be done.

SUMMARY OF THE INVENTION

It is hence a primary object of the invention to solve the above-discussed problem of the prior art to present an air-fuel ratio controller capable of controlling the air-fuel ratio adequately even when the outputs of the oxygen content detecting means are abnormal, by installing means for stopping the operation of the smoothing means when the outputs of the oxygen content detecting means do not change largely enough over a specific time.

The above and further objects and features of the invention will more fully be apparent from the following detailed description with accompanying drawings.

DESCRIPTION OF THE PREFERRED EMBODIMENTS

Figure 1:
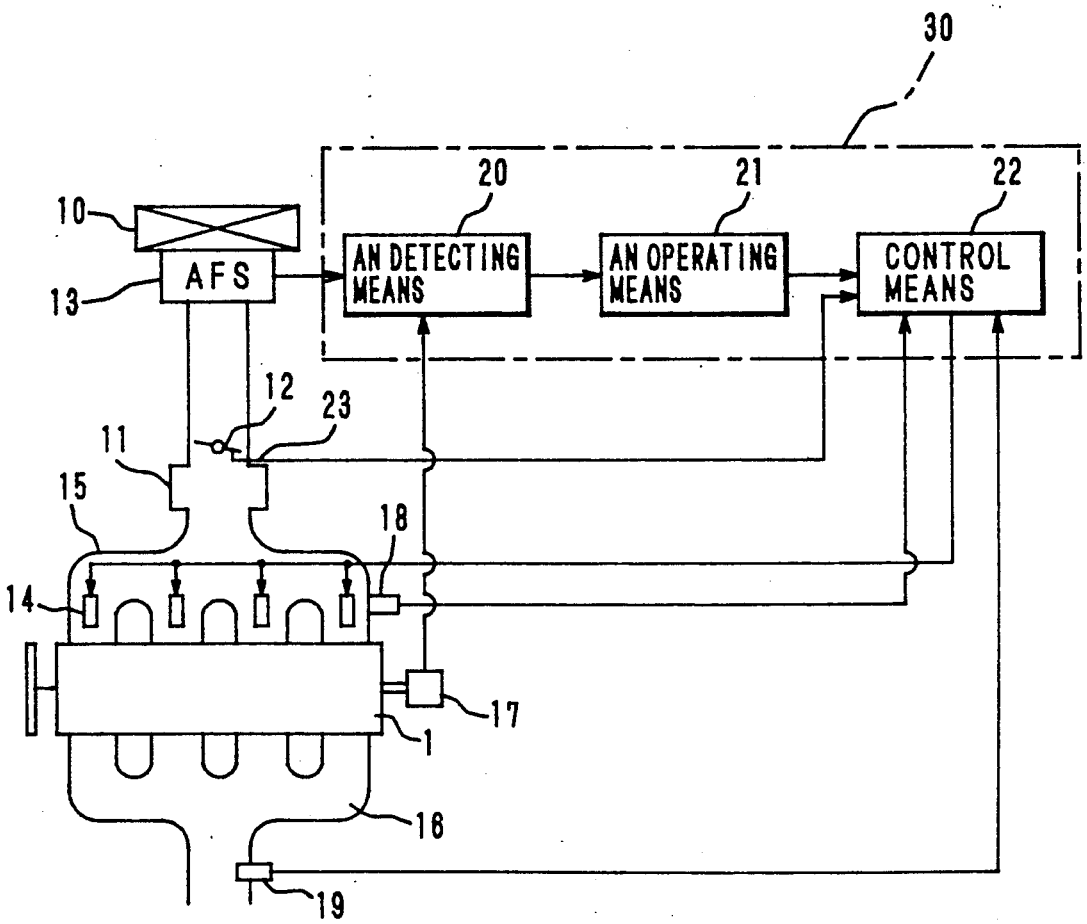
FIG. 1 is a block diagram showing the construction of an air-fuel ratio controller of the invention.

Referring now to the drawings, an air-fuel ratio controller of the invention is described below in further detail.

FIG. 1 is a block diagram showing the construction of an air-fuel ratio controller. In the figure, numeral 10 denotes an air cleaner for purifying the intake air, and in the downstream of the air cleaner 10 is disposed an air flow sensor (AFS, hereinafter) 13 for outputting pulses according to the volume of the intake air to the engine 1. The pulses outputted from the AFS 13 are applied to an AN detecting means 20 for detecting load. A crank angle sensor 17 outputs pulses according to the rotation of the engine 1, and the pulses are applied to AN detecting means 20. The AN detecting means 20 counts the number of output pulses of the AFS 13 within a specific crank angle of the engine 1 according to the pulses applied from the AFS 13 and crank angle sensor 17, and sends the result to AN operating means 21. The AN operating means 21 calculates the true intake by the output of the AN detecting means 20, and applies it to control means 22.

Figure 3:
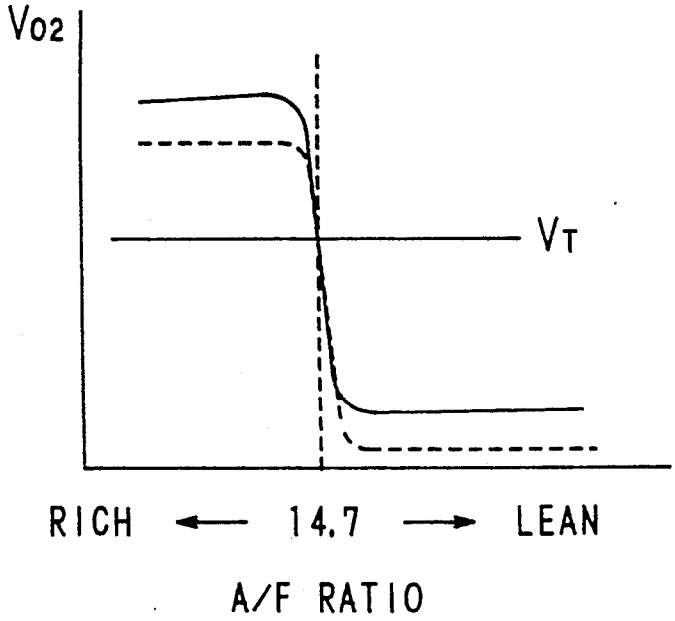
FIG. 3 is a graph showing the output characteristic of the oxygen content sensor.

In the downstream of the AFS 13 are disposed a throttle valve 12 for controlling the intake flow rate, and a surge valve 11 for reducing fluctuations of the flow rate. Onto the throttle valve 12 is provided an idle switch 23 for detecting idling state, and the result of detection is given to the control means 22. In the downstream of the surge tank 11 is disposed an intake chamber 15 in which four injectors 14 for injecting fuel being installed. The control means 22 controls the fuel feed rate by controlling the driving time of these injectors 14. The intake chamber 15 comprises a water temperature sensor 18 for detecting the temperature of cooling water of the engine 1, and the result of detection by the water temperature sensor 18 is given to the control means 22. At the exit of an exhaust chamber 16 is provided an oxygen content sensor ($O_2$ sensor, hereinafter) 19 for detecting the air-fuel ratio from the oxygen content of the exhaust gases. FIG. 3 is a graph showing the output characteristic of the $O_2$ sensor 19 letting the objective air-fuel ratio be 14.7, and the corresponding output level of the $O_2$ sensor 19 be Vr.

Figure 2:
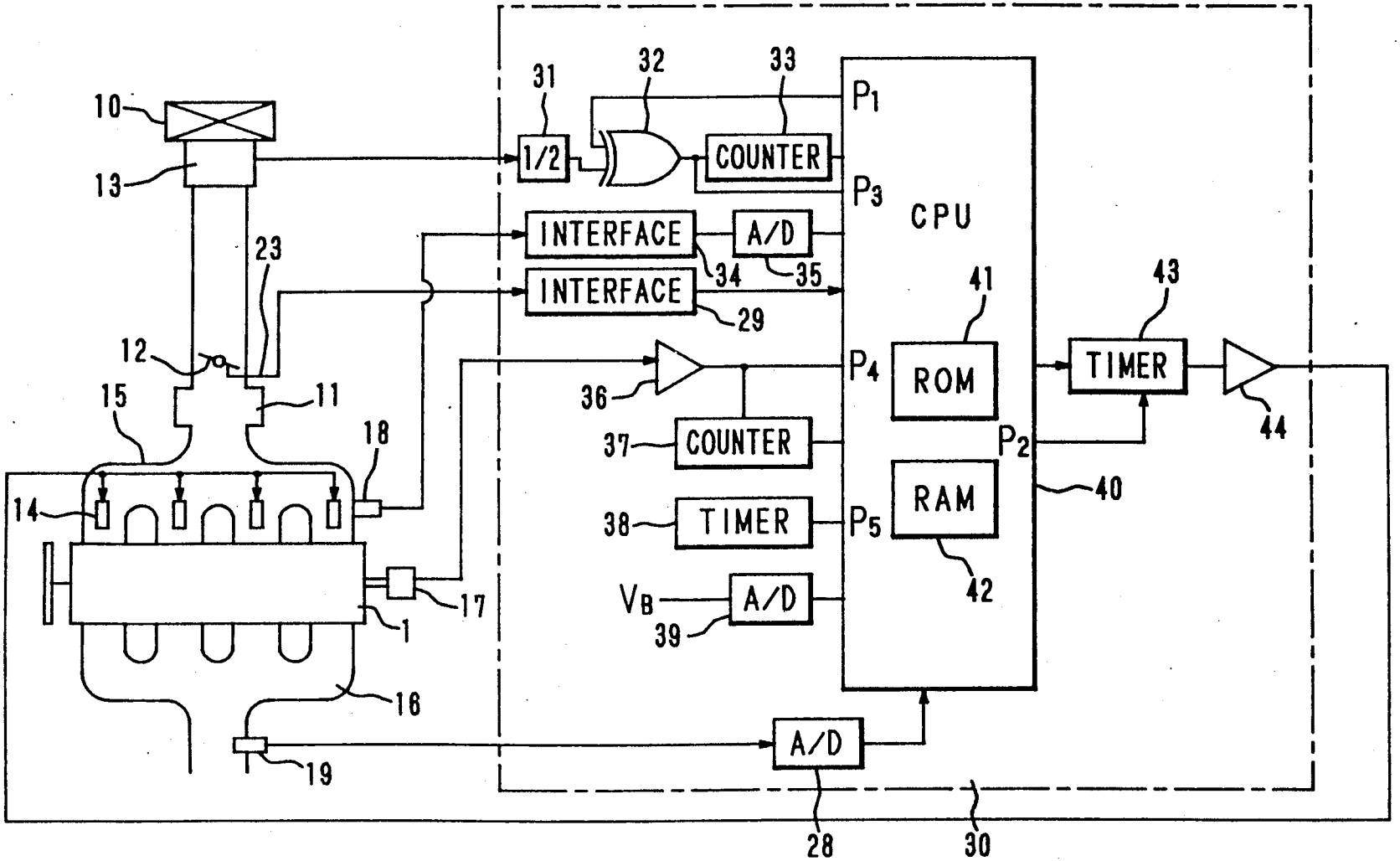
FIG. 2 is a block diagram showing a part of the construction in detail.

FIG. 2 is a block diagram showing the details of the construction of the control device 30 comprising the aforesaid AN detecting means 20, AN operating means 21 and control means 22 of the air-fuel ratio controller. The control device 30 controls four injectors 14 installed in each cylinder of the engine 1 by the output signals from the AFS 13, water temperature sensor 18, idle switch 23, $O_2$ sensor 19, and the crank angle sensor 17. Numeral 40 in the figure denotes CPU comprising ROM 41 and RAM 42, and having output ports P1, P2, and interruption input ports P2, P3, P4, P5.

The output of the AFS 13 is inputted into a ½ frequency divider 31, of which output is connected to one input terminal of an exclusive OR gate 32. Another input terminal of the exclusive OR gate 32 is connected to the output port P1 of the CPU 40, and the output terminal of the exclusive OR gate 32 is connected to a counter 33 and an interruption input port P3 of the CPU 40. The output of the idle switch 23 is inputted to the CPU 40 through an interface 29. The output of the water temperature sensor 18 is inputted to the CPU 50 through an interface 34 and A/D converter 35. The output of the crank angle sensor 17 is inputted to the interruption input port P4 of the CPU 40, as well as a counter 37 through a waveform shaping circuit 36. The output of the $O_2$ sensor 19 is inputted into the CPU 40 through an A/D converter 28. The voltage of battery VB not shown is inputted to the CPU 40 through an A/D converter 39. A timer 38 is connected to the interruption input port P5. The output port P2 of the CPU 40 is connected to a driver 44 through a timer 43 controlled by the CPU 40. The output terminal of the driver 55 is connected to each injector 14.

The operation of the controller with above construction is explained below. The outputs of the AFS 13 are divided by the ½ frequency divider 31, and inputted to the counter 33 through the exclusive OR gate 32 controlled by the CPU 40. The counter 33 measures the period between falling edges of the output pulses of the exclusive OR gate 32. The fall of the exclusive OR gate 32 is inputted into the interruption input port P3 of the CPU 40. The CPU 40 interrupts in every output pulse period of the AFS 13 or its ½ divided period, and measures the period of the counter 33. The outputs of the water temperature sensor 18 are converted into voltage by the interface 34, and converted into digital values in every predetermined time by the A/D converter 35 and taken into the CPU 40. The outputs of the crank angle sensor 17 are inputted to the interruption input port P4 of the CPU 40 and the counter 37 through the waveform shaping circuit 36. The output of the idle switch 23 is inputted into the CPU 40 through the interface 29.

The CPU 40 interrupts in every pulse rise of the crank angle sensor 17, and detects the period between pulse rises of the crank angle sensor 17 from the output of the counter 37. In every predetermined time, the timer 38 generates an interruption signal to the interruption input port p5 of the CPU 40. The A/D converters 39, 28 convert the outputs of the $O_2$ sensor 19 as well as the battery voltage VB not shown from analog to digital. The CPU 40 inputs the outputs of the $O_2$ sensor 19 and data of the battery voltage in every predetermined time. The timer 43 is preset by the CPU 40, being triggered by the output port P2 of the CPU 40, and outputs pulses with specific width which drive the injectors 14 through the driver 44.

Figure 5:
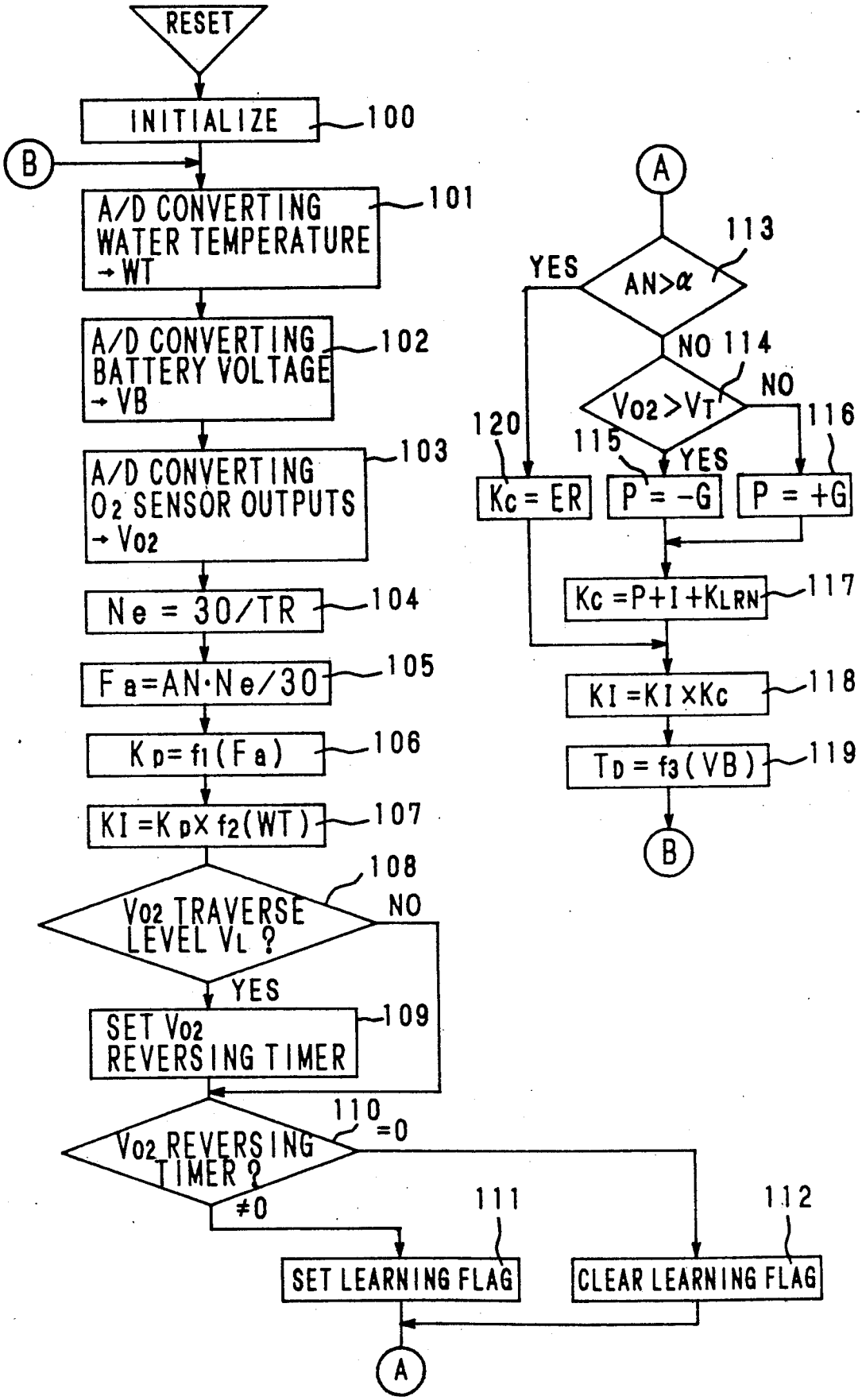
FIG. 5, FIG. 6, FIG. 9 and FIG. 10 are flowcharts showing the operation of the controller of the invention.
Figure 7:
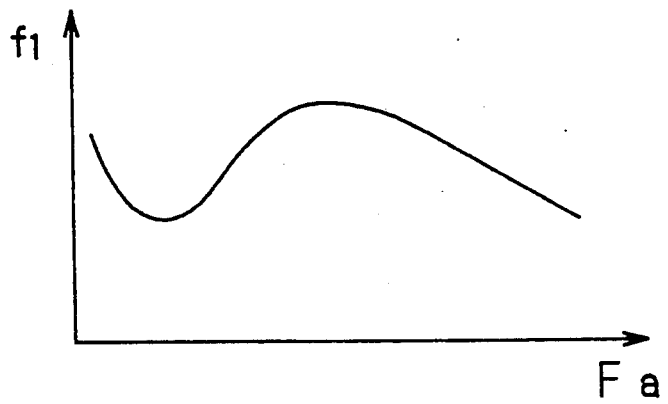
FIG. 7 is a graph showing the relation between AFS output frequency and fundamental converting coefficient for the driving time, FIGS. 8(*a–d*) are a time chart of the operation of each part of the controller of the invention, and FIGS. 11(*a–d*) are a timing chart of the operations shown in flowcharts in FIG. 5, FIG. 6, FIG. 9 and FIG. 10.

The operation of the CPU 40 is explained below referring to the flowchart. In FIG. 5, the main program of the CPU 40 is shown. When a reset signal is inputted to the CPU 40, the RAM 42, input, output ports and others are initialized (step 100). The outputs of the water temperature sensor 18 are converted from analog to digital, and stored as WT in the RAM 42 (step 101). The battery voltage is converted from analog to digital and stored as VB in the RAM 42 (step 102). The outputs of the $O_2$ sensor 19 are converted from analog to digital and stored as Vo2 in the RAM 42 (step 103). 30/TR is calculated from the period TR of the crank angle sensor 17, which is the rotating speed Ne (step 104). An x Ne/30 is calculated from the load data AN and rotating speed Ne, which is the output frequency Fa of the AFS 13 (step 105). The fundamental driving time conversion coefficient Kp is calculated from f1 in responsive to the output frequency Fa, as shown in FIG. 7 (step 106). The fundamental driving time converting coefficient Kp is corrected by the water temperature WT, and stored as the driving time converting coefficient $K_1$ in the RAM 42 (step 107).

Figure 4:
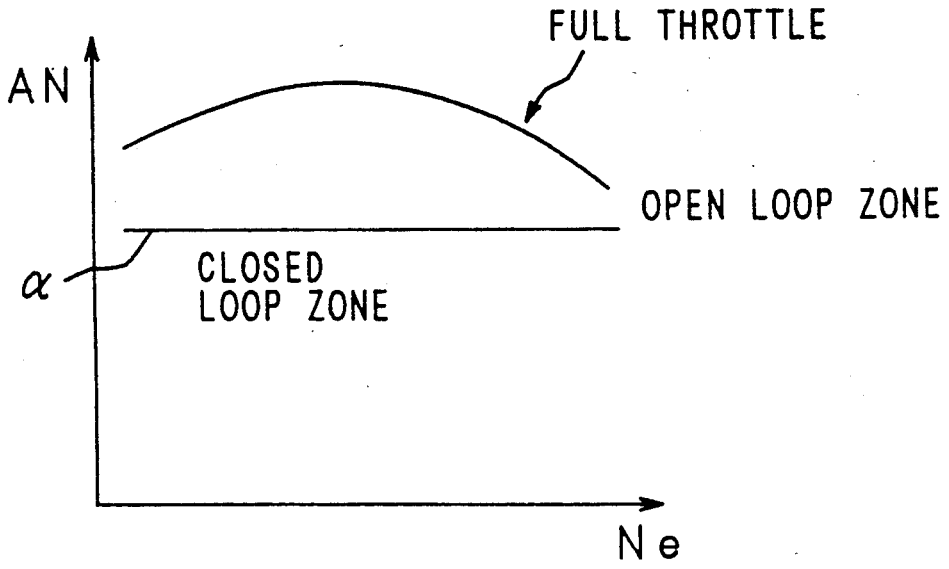
FIG. 4 is a graph showing zones of the control method of the controller of the invention.
Figure 8:
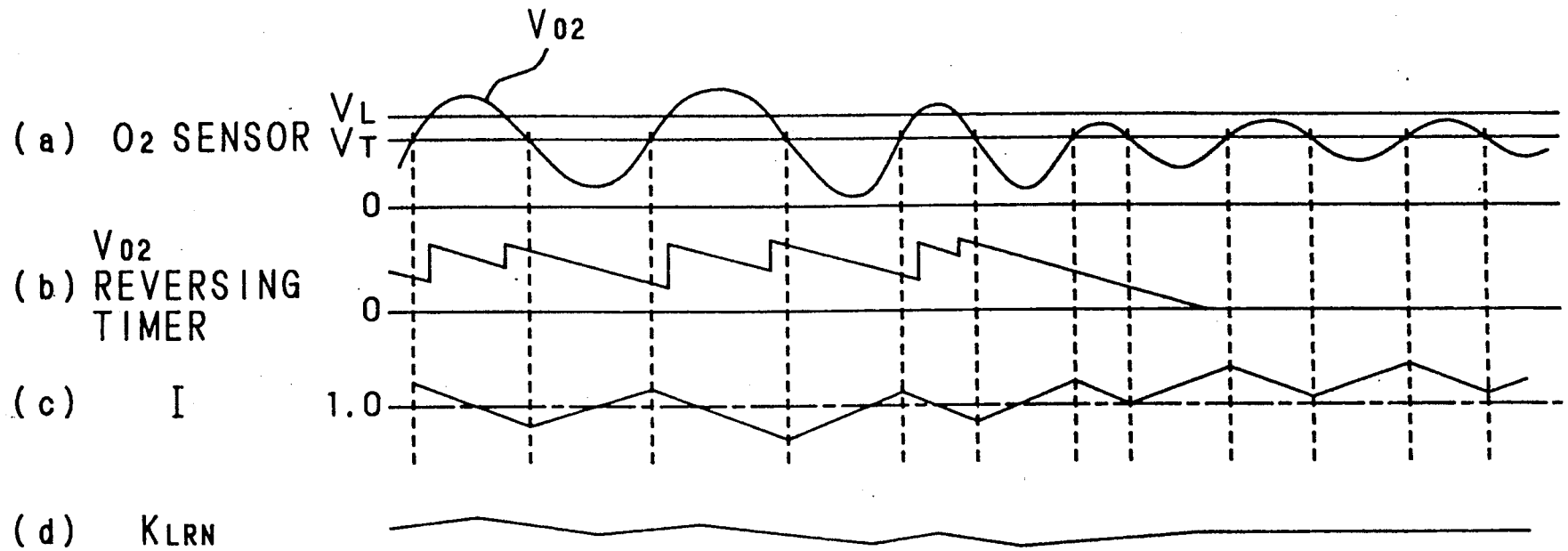

As in the timing chart shown in FIG. 8 (*a*), whether the outputs of Vo2 of the $O_2$ sensor 19 cross the specified level VL or not is judged, that is, whether the outputs are reversed from plus to minus from the level VL (step 108). When reversed, a reversing timer is set as shown in FIG. 8 (*b*) (step 109). Judging whether the inverting timer is zero or not (step 110), when not zero, a learning flag is set (step 111), and when zero, the learning flag is cleared (step 112). The load AN and a specified value $\alpha$ are compared (step 113). This value of $\alpha$ is the magnitude of the load for branching the control by the open loop and the control by the closed loop according to the relation between the rotating speed Ne and; the load AN shown in FIG. 4. When AN $<\alpha$, that is, when the load is not high, the feedback control is effected.

Figure 6:
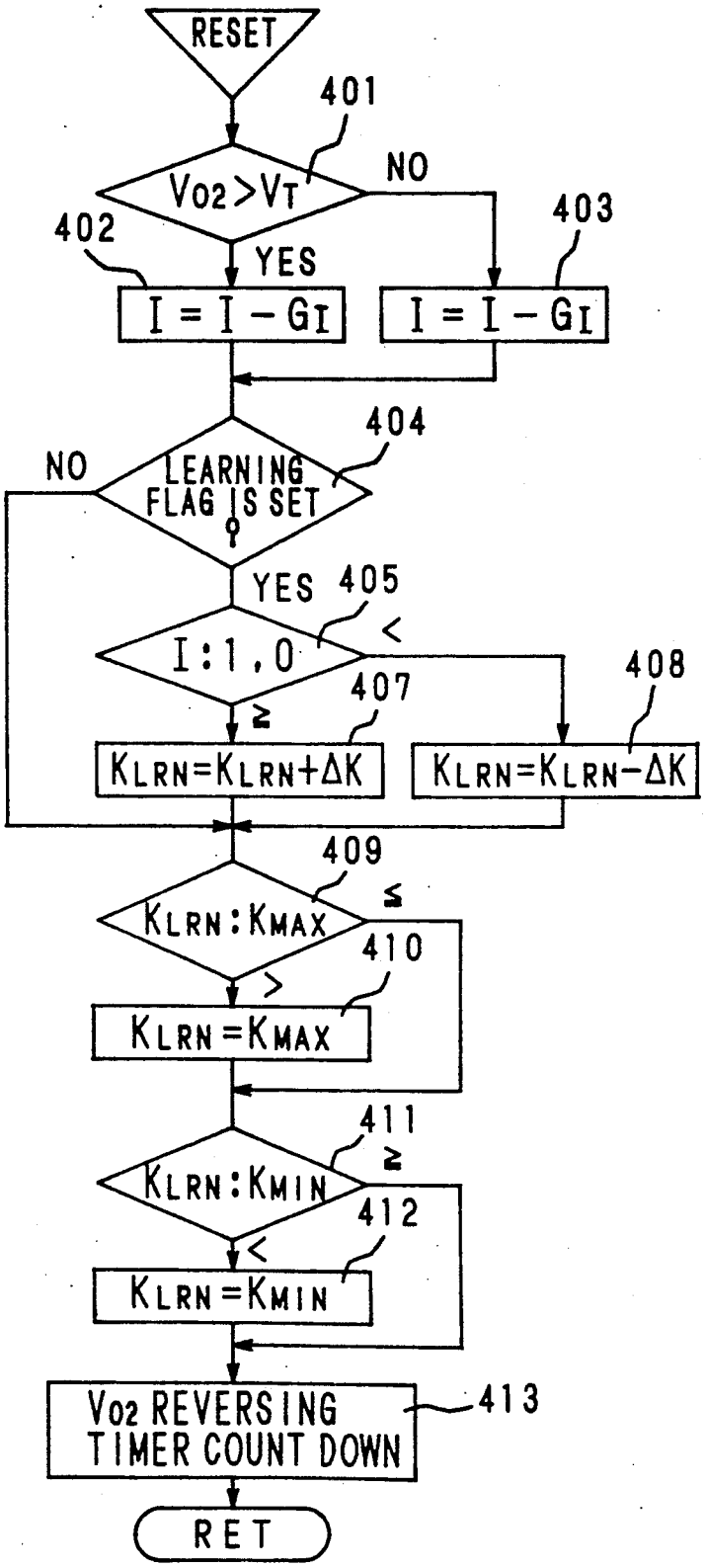

The sequence of feedback control is as follows. Vo2 and reference value $V_T$ are compared (step 114), and when Vo2 $>V_T$, P$=-$G is set, that is, the gain (G) of the proportional action (P) is negative (step 115), and when Vo2$<V_T$, the setting is P=G (step 116). Thereby, the correcting coefficient Kc of the driving time converting coefficient $K_I$ is calculated as follows: Kc$=$P$+$I$+K_{LRN}$ (step 117). The procedure of determining this integrated value I and learning value $K_{LRN}$ is explained according to the flowchart shown in FIG. 6. When interrupted by the timer 38, the CPU 40 compares the Vo2 and $V_T$ (step 401), and when Vo2$>V_T$, $G_I$ is subtracted from the previous value to determine I$=$I$-G_I$ (step 402). When Vo2$<V_T$, I$=$I$+G_I$ is determined (step 403). Judging whether the learning flag is set or not (step 404), when not set, the operation goes to step 409. When set, judging whether I is greater than 1.0 or not (step 405), and when greater, it is set as $K_{LRN}=K_{LRN}+\Delta K$ (step 407), and when smaller, it is set as $K_{LRN}=K_{LRN}-\Delta K$ (step 408). $K_{LRN}$ is compared with the predetermined maximum value $K_{MAX}$ (step 409), and when greater than $K_{MAX}$, it is clipped at $K_{MAX}$ (step 410), and when smaller than the minimum value $K_{MIN}$, it is clipped at $K_{MIN}$ (step 412).

The Vo2 reversing timer is counted down (step 413). FIG. 8 (*c*), (*d*) show changes of I, $K_{LRN}$.

Accordingly, supposing $K_I=K_I\times$Kc, the driving time inverting coefficient $K_I$ of the injectors 14 is corrected by the correction coefficient Kc (step 118). On the basis of the battery voltage data VB, the data table f3 preliminarily stored in the ROM 41 is mapped, and the loss time Tp is calculated and stored in the RAM 42 (step 119). After the processing at step 119, the process following step 101 is repeated. Thus, when the output Vo2 is greater than the reference value $V_T$, the air-fuel ratio is rich, and the driving pulse width is gradually decreased. In consequence, when the air-fuel ratio becomes lean or Vo2$<V_T$, the pulse width is increased gradually to the contrary.

Figure 9:
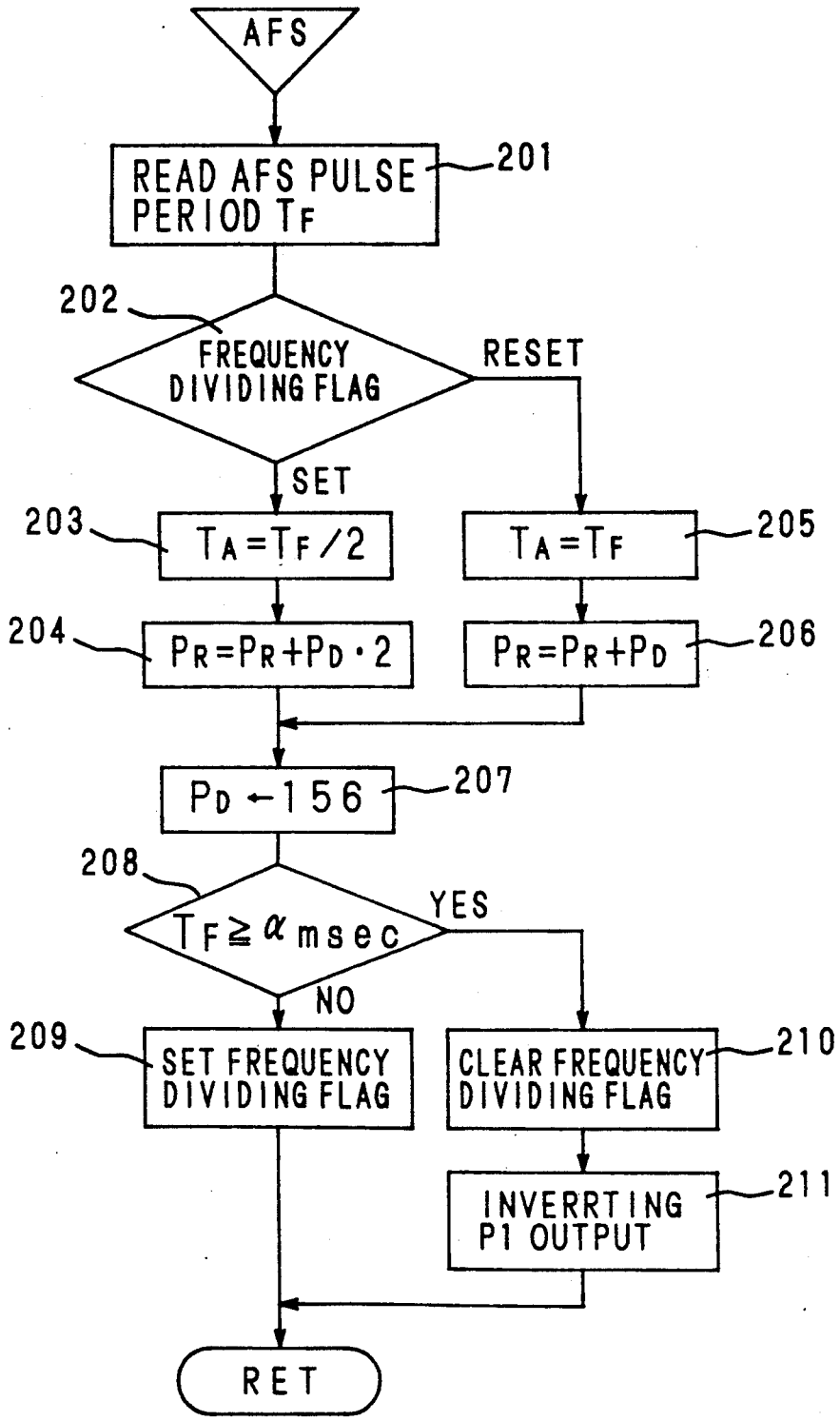

On the other hand, when AN$>\alpha$, that is, when the load is high, Kc$=$ER is set (step 120), and the operation goes to steps 118, 119. That is, under high load, the open loop control is effected, and the driving time of the injectors 14 is determined that the air-fuel ratio may be about 20% richer than the theoretical air-fuel ratio. This is for obtaining a high output of the engine and for protecting the engine as well. FIG. 9 is a flowchart showing an interruption processing for output signal of AFS 13 to the interruption input port P3. After detecting the output $T_F$ of the counter 33, the counter 33 is cleared (step 201). This $T_F$ is the period between pulse falling edges of the exclusive OR gate 32. When the frequency dividing flag in the RAM 42 is set (step 202), $T_F$ is divided into two halves to obtain output pulse period $T_A$ of the AFS 13, which is stored in the RAM 42

(step 203). The remaining pulse data $P_D$ increased to double is added to the integrated pulse data $P_R$ to obtain new integrated pulse data $P_R$ (step 204). This integrated pulse data $P_R$ is obtained by integrating the number of pulses of the AFS 13 outputted in the period between pulse rising edges of the crank angle sensor 17, and it is handled by multiplying by 156 times for the convenience of processing for one pulse of the AFS 13. When the frequency dividing flag is reset (step 202), the period $T_F$ is stored in the RAM 42 as the output pulse period $T_A$ (step 205), and the remaining pulse data $P_D$ is added to the integrated pulse data $P_R$ (step 206). As the remaining pulse data PD, 156 is set (step 207). Under the condition $T_F>2$ msec when the frequency dividing flag is reset and $T_F>4$ msec when it is set, the operation goes to step 210, and otherwise to step 209 (step 208). At step 209, the frequency dividing flag is set, and at step 210, the frequency dividing flag is cleared to invert the output port $P_1$ (step 211). Therefore, in the processing of step 209, the signals are inputted to the interruption input port P3 at the timing of ½ dividing of the output pulse of the AFS 13. When the processing at step 210 is done, the signals are inputted to the interruption input port P3 at every output pulse of the AFS 13. After processing of steps 209, 211, the interruption processing is over.

Figure 10:
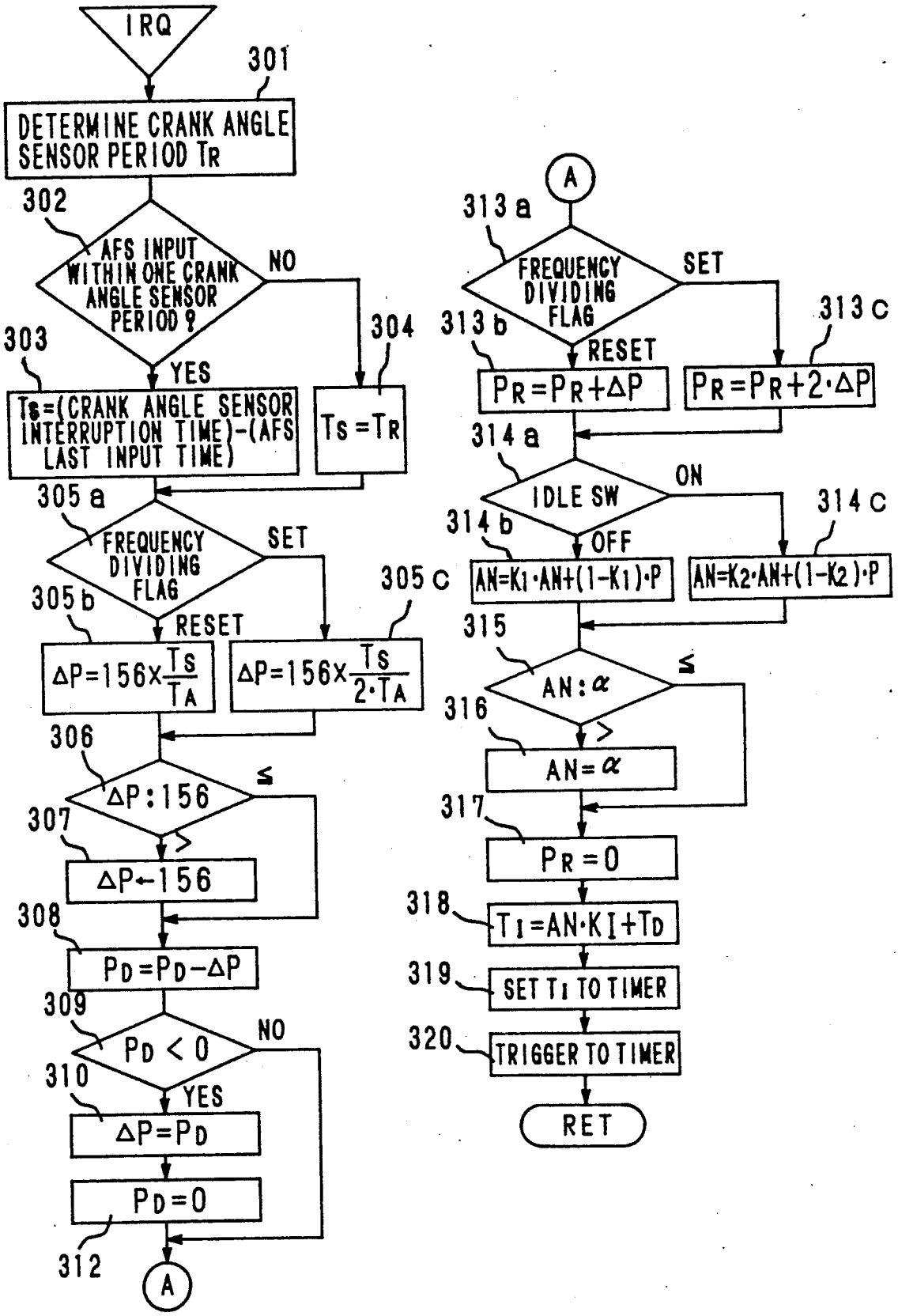

FIG. 10 is a flowchart showing an interruption processing when an interruption signal is inputted to the interruption input port P4 of the CPU 40 due to the output of the crank angle sensor 17. The period between pulse rising edges of the crank angle sensor 17 is read from the counter 37, and stored as period $T_R$ in the RAM 42, thereby clearing the counter 37 (step 301). When there is an output pulse of AFS 13 within the period $T_R$ (step 302), the time difference $\Delta t$ of the time t1 of the last output pulse of the AFS 13 and the present interruption time t2 of the crank angle sensor 17 is calculated as $\Delta t = t2 - t1$, and $\Delta t$ is stored as a period Ts (step 303). When there is no output pulse of the AFS 13 in the period $T_R$, the period $T_R$ is set as period Ts (step 304). Whether the frequency dividing flag is set or not is judged (step 305*a*). When reset, by the calculation of $156 \times Ts/T_A$, and when set, by the calculation of $156 \times Ts/2 \times T_A$, the time difference $\Delta t$ is converted to the output pulse data $\Delta P$ of the AFS 13 (step 305*b, c*). That is, assuming that the last output pulse period of the AFS 13 and the present output pulse period of the AFS 13 coincide with each other, the pulse data $\Delta P$ is calculated. At step 306, when the pulse data $\Delta P$ is smaller than 156, the operation goes to step 308, and when greater, $\Delta P$ is clipped at 156 at step 307. At step 308, by subtracting $\Delta P$ from the remaining pulse data $P_D$, new remaining pulse data $P_D$ is obtained. At step 309, when the remaining pulse data $P_D$ is positive, the operation goes to step 313*a*. Otherwise, the calculated value of the pulse data $\Delta P$ is much greater than the output pulse of the AFS 13, so that at step 310 the pulse data $\Delta P$ is set equal to $P_D$, and at step 312 the remaining pulse data is set to zero.

Whether the frequency dividing flag is set or not is judged (step 313*a*), and when reset, the pulse data $\Delta P$ is added to the integrated pulse data $P_R$ (step 313*b*). When set, $2 \times \Delta P$ is added to $P_R$, thereby obtaining new integrated pulse data $P_R$ (step 313*c*). This integrated pulse data $P_R$ corresponds to the number of pulses considered to be outputted from the AFS 13 in the present period between pulse rising edges of the crank angle sensor 17.

Referring to the load data AN and integrated pulse data $P_R$ calculated until the previous rising of the crank angle sensor 17, when the idle switch 23 is ON, the state is judged as idling (step 314*a*), and $AN = K_2AN + (1-K_2)\,PR$ is calculated. If the idle switch 23 is OFF, $K_1AN + (1-K_1)PR$ is calculated ($K_1 > K_2$), and the result is set as the present new load data AN (314*b,c*). When this load data AN is larger than the specified value $\alpha$ (step 315), it is clipped at $\alpha$ (step 316), so that the load data AN may not be greater than the actual value when the engine 1 is in full throttle.

Consequently, the integrated pulse data $P_R$ is cleared (step 317). From the load data AN, driving time converting coefficient $K_1$, and the dead time $T_D$, the driving time data $T_1$ is calculated as $T_1 = AN \times K_1 + T_D$ (step 318). Setting the driving time data $T_1$ to the timer 43 (step 319), by triggering the timer 43 (step 320), four injectors 14 are simultaneously driven depending on the data $T_1$, thereby completing the interruption processing.

Figure 11:
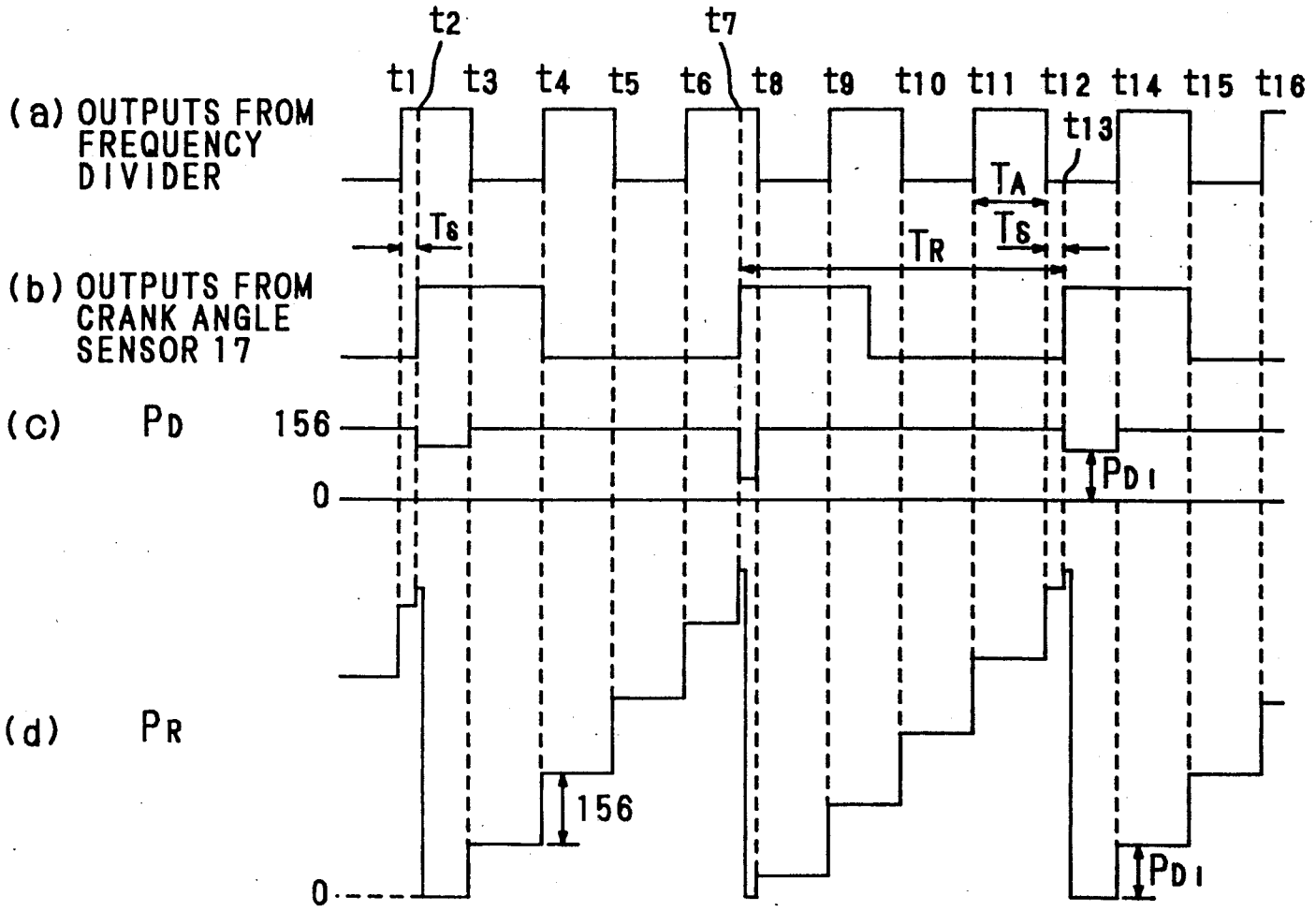

FIG. 11 is a timing chart showing the timing of the processes shown in FIGS. 5, 6, and 9, 10 when the frequency dividing flag is cleared. FIG. 11 (*a*) denotes the outputs from the frequency divider 31, (*b*) shows the outputs from the crank angle sensor 17. FIG. 11 (*c*) indicates the pulse data $P_D$, which is set to 156 at every pulse rising or falling edge of the frequency divider 31 (the falling edge is corresponding to a rising edge of the output pulse of AFS 13), and is changed to the calculation result of $P_Di = P_D - 156 \times Ts/T_A$, for example, at every pulse rising of the crank angle sensor 17 (it corresponds to the processing at steps 305 to 312). FIG. 11 (*d*) shows the changes of the integrated pulse data $P_R$, where the remaining pulse data $P_D$ is integrated at every rising or falling of the output from the frequency divider 31.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the metes and bounds of the claims, or equivalence of such metes and bounds thereof are therefore intended to be embraced by the claims.

What is claimed is:

1. An air-fuel ratio controller comprising:

oxygen content detecting means for detecting oxygen content of the engine exhaust gases, deviation calculating means for calculating deviation between an objective oxygen content value corresponding to an objective air-fuel ratio and the detected value by said oxygen content detecting means, integrating means for integrating the calculated values by said deviation calculating means, smoothing means for smoothing the integrated values by said integrating means, time measuring means, comparing means for comparing the detected value by said oxygen content detecting means with a predetermined value, and making said time measuring means measure time according to the result of comparison, and means for stopping said smoothing means when said comparing means does not make said time measuring means measure time during a predetermined period.

2. An air-fuel ratio controller as set forth in claim 1, wherein said comparing means includes means for judging whether or not the deviation between said detected value and said objective oxygen content value is more than that between said predetermined value and said objective oxygen content value, and means responsive to said judging means for controlling said time measuring means.

3. An air-fuel ratio controller as set forth in claim 1, wherein said time measuring means measures time whenever said detected value varies from under to over or from over to under said predetermined value.

* * * * *